US010602912B2

(12) United States Patent
Rosin

(10) Patent No.: US 10,602,912 B2
(45) Date of Patent: Mar. 31, 2020

(54) DEVICE FOR CLEANING A SHOE SOLE

(71) Applicant: Laurie Rosin, Sarasota, FL (US)

(72) Inventor: Laurie Rosin, Sarasota, FL (US)

(73) Assignee: RENAISSANCE WOMAN, INC., Sarasota, FL (US)

( * ) Notice: Subject to any disclaimer, the term of this patent is extended or adjusted under 35 U.S.C. 154(b) by 27 days.

(21) Appl. No.: 15/875,586

(22) Filed: Jan. 19, 2018

(65) Prior Publication Data

US 2018/0199793 A1 Jul. 19, 2018

Related U.S. Application Data

(60) Provisional application No. 62/448,167, filed on Jan. 19, 2017.

(51) Int. Cl.

| | |
|---|---|
| ***A47L 23/04*** | (2006.01) |
| ***A46B 11/00*** | (2006.01) |
| ***A46B 9/02*** | (2006.01) |
| ***A46B 5/00*** | (2006.01) |

(52) U.S. Cl.

CPC ..... *A47L 23/04* (2013.01); *A46B 5/0016* (2013.01); *A46B 9/02* (2013.01); *A46B 11/0041* (2013.01); *A46B 11/0062* (2013.01); *A46B 2200/306* (2013.01)

(58) Field of Classification Search

CPC . A46B 5/0016; A46B 5/0095; A46B 11/0041; A46B 11/0062; A46B 2200/306; A47L 23/04

USPC ..... 401/39

See application file for complete search history.

(56) References Cited

U.S. PATENT DOCUMENTS

| | | | | |
|---|---|---|---|---|
| 1,372,523 | A | 3/1921 | Lohman | |
| 1,676,601 | A * | 7/1928 | Cavanaugh | A46B 11/0041 401/183 |
| 1,833,434 | A * | 11/1931 | Priest | A46B 5/0095 401/177 |
| 2,257,606 | A | 9/1941 | Herbert | |
| 3,090,070 | A * | 5/1963 | Simons | A46B 9/02 401/183 |
| 5,307,847 | A | 5/1994 | Pavenick et al. | |
| 2001/0054211 | A1* | 12/2001 | Cabedo-Deslierres | A46B 5/0016 15/106 |
| 2006/0171768 | A1 | 8/2006 | Hoadley et al. | |
| 2007/0071535 | A1 | 3/2007 | Young et al. | |
| 2009/0282634 | A1 | 11/2009 | Pardini | |

(Continued)

*Primary Examiner* — David J Walczak
*Assistant Examiner* — Bradley S Oliver
(74) *Attorney, Agent, or Firm* — Matthew G. McKinney, Esq.

(57) ABSTRACT

A device to clean a shoe sole includes a handle portion having a first end and an opposing second end, and is configured to store a cleaning fluid therein. The device also includes a tread brush coupled to the first end of the handle portion, a grooming brush coupled to the opposing second end of the handle portion, where the tread brush includes an orifice that is in fluid communication with a reservoir of the handle portion. The tread brush comprises tread bristles facing outward relative to a first side of the handle portion, and the grooming brush comprises grooming bristles facing outward relative to an opposing second side of the handle portion. In addition, the tread brush comprises a tapered end that is configured to fit between treads of a shoe.

18 Claims, 4 Drawing Sheets

(56) References Cited

U.S. PATENT DOCUMENTS

2011/0197917 A1 8/2011 Koptis et al.

* cited by examiner

DEVICE FOR CLEANING A SHOE SOLE

RELATED APPLICATION

The present invention is related to U.S. Provisional Patent Application Ser. No. 62/448,167 filed Jan. 19, 2017, the entire contents of which are incorporated herein by reference.

TECHNICAL FIELD

The present invention relates to the field of cleaning devices, and, more particularly, to a device for cleaning a shoe sole.

BACKGROUND

Shoe soles catch dirt, mud and other material, which is especially prevalent in many underdeveloped countries that have no infrastructure for cleaning streets or even keeping garbage off the streets. In addition, many places do not have sidewalks, and there is no choice but to walk in the street and step in accumulations of germ-infested piles of various materials. Tracking dirt and germs into the house (or hotel room) can be hazardous to the occupant's health, and in particular it can be a serious health issue where children crawl and play on the floor.

In addition, the soles can greatly affect the overall life of shoes. For example, leather soles can crack and pull away from shoe stitching. Keeping the soles of shoes clean and in good repair help to avoid stains, dirt, and damage to the shoes.

Current methods to clean the shoe soles include running water over the soles in a sink and drying with a towel. However, this can create a mess in the sink and can be a health hazard to the person cleaning the shoes as the dirty water runs over hands, and in particular if an open wound on the hands comes into contact with the dirty water it may lead to an infection.

Shoe brushes are generally used to clean the uppers of the shoes and are not suitable to clean the shoe sole and to dislodge material within the treads. Another shortcoming of the existing brushes is the inability to pack dirty brushes within luggage when traveling. Accordingly, there is a need in the art for an improved device for cleaning a shoe sole.

SUMMARY

In view of the foregoing background, it is therefore an object of the present invention to provide a device to clean a shoe sole that is efficient and also can be easily packed with luggage for traveling. The device includes a handle portion having a first end and an opposing second end, and is configured to store a cleaning fluid therein. The device also includes a tread brush coupled to the first end of the handle portion, and a grooming brush coupled to the opposing second end of the handle portion. The handle portion includes an orifice in fluid communication with the tread brush.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
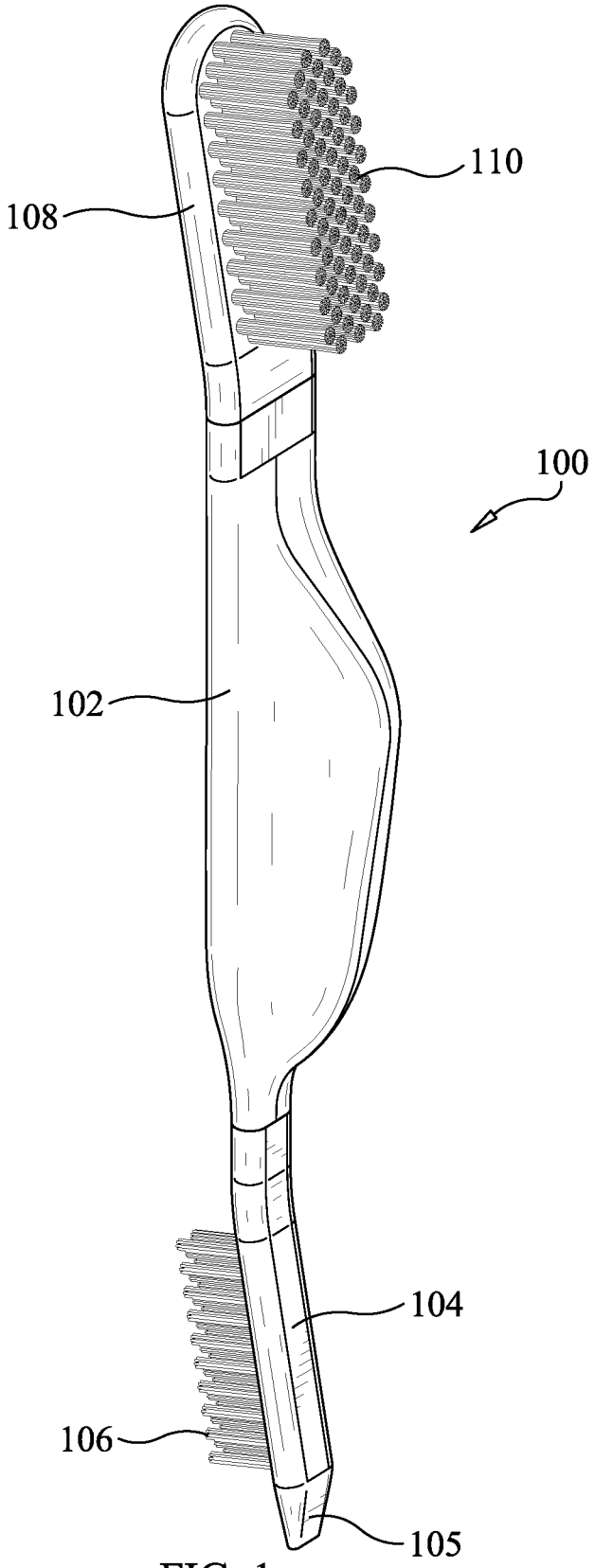
FIG. 1 is a front perspective view of a device for cleaning a shoe sole in accordance with a particular embodiment of the invention.
Figure 2:
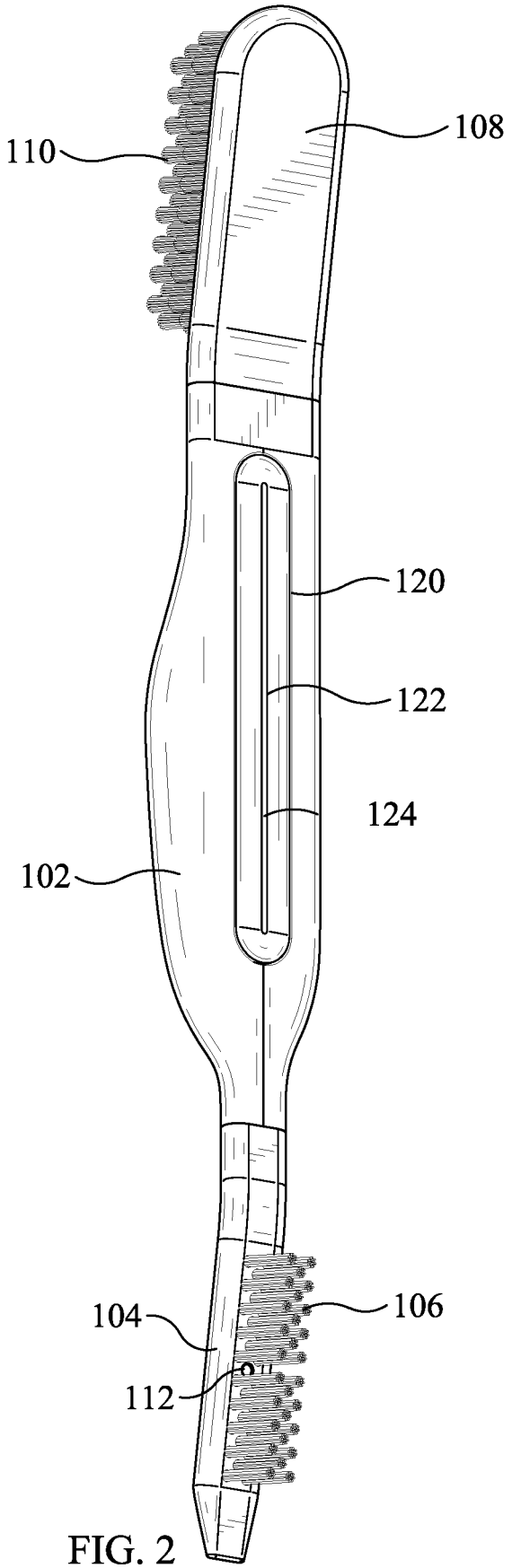
FIG. 2 is a rear perspective view of the device in accordance with a particular embodiment.
Figure 3:
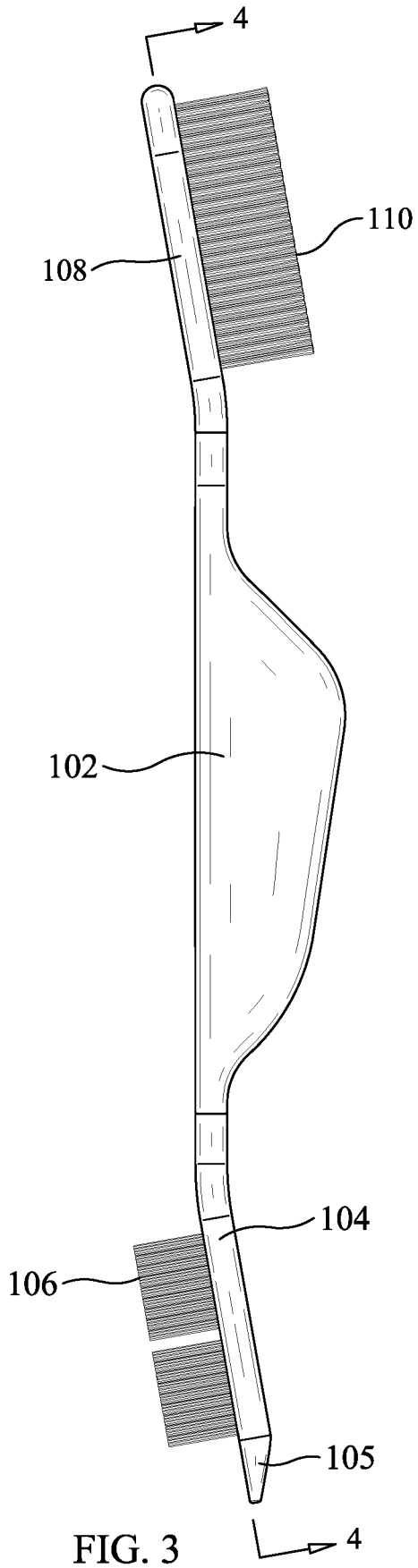
FIG. 3 is an elevational view of the device.

Referring now to FIGS. 1-3, a particular illustrative embodiment of a device for cleaning a shoe sole is disclosed. The device 100 includes a handle portion 102, a tread brush 104 on a first end of the handle portion 102, and a grooming brush 108 at an opposing second end of the handle portion 102.

The tread brush 104 includes rigid firm bristles 106 and is configured to fit between the treads of running shoes, for example, and has a chisel tip tapered end 105. The tapered end 105 is similar to that of a flat head screwdriver, giving a user a convenient and rigid tool for clearing out the treads of shoes. The grooming brush 108 is larger than the tread brush 104 and may have relatively softer bristles 110 compared to the tread brush 104, and is configured to sweep over the shoe sole.

In a particular embodiment, the tread brush 104 comprises a width of 0.47 inches that tapers to the chisel tip tapered end 105 having a width of 0.28 inches. The grooming brush 108 comprises a width of 1.0 inches. The angle of the tread brush 104 to the handle portion 102 may be about 170 degrees, and the angle of the grooming brush 108 to the handle portion 102 may also be about 170 degrees, but facing in the opposing direction.

Figure 4:
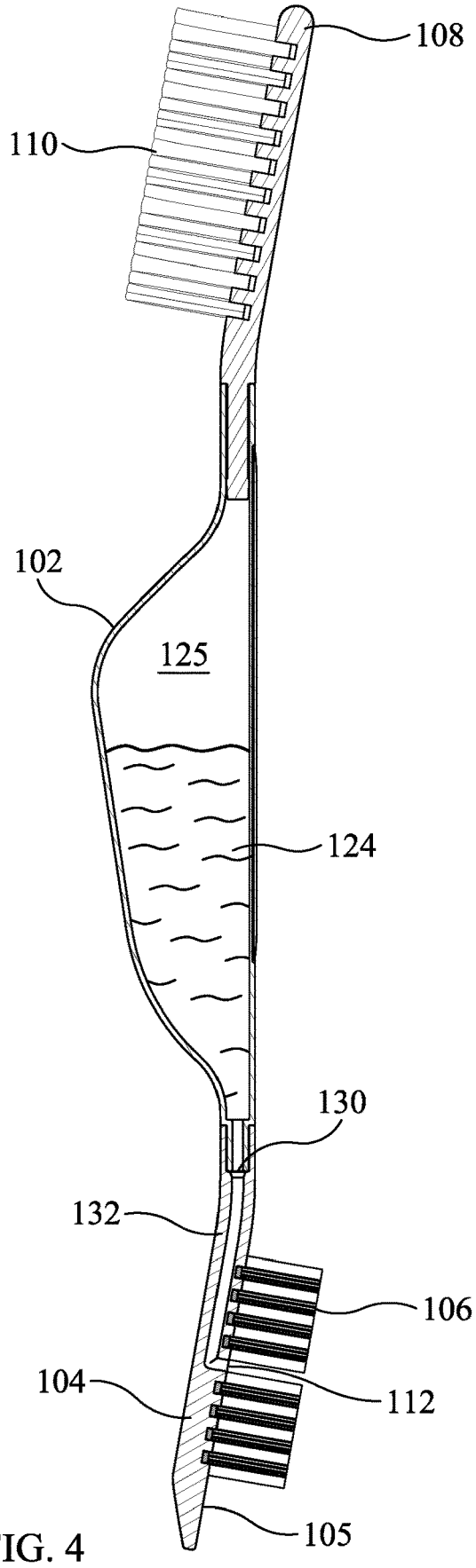
FIG. 4 is a cross sectional view taken in the direction of line 4-4 of FIG. 3.

The handle portion 102 may be hollow to form a reservoir 125 and configured to store a cleaning fluid 124 therein (see FIG. 4). In a particular embodiment the volume of the reservoir 125 may be 30 mL. The tread brush 104 may be in fluid communication with the cleaning fluid 124 that is stored in the reservoir 125 via an orifice 112 at an interface between the bristles 106 of the tread brush 104. The orifice 112 may comprise a spray nozzle configured to disperse the cleaning fluid 124. The handle portion 102 is ergonomically shaped in order to make it comfortable for the user to use the device 100.

The grooming brush 108 is wider than the tread brush 104 as can be seen in the various figures. In a particular embodiment, the tread brush 104 and the grooming brush 108 face opposing directions. However, the tread brush 104 and the grooming brush 108 could be facing the same direction in a particular embodiment. The tread brush 104 may be an injection molded piece that is configured to snap to the handle portion 102 by way of a slight undercut lip. The grooming brush 108 may also be an injection molded piece and is firmly slid into the opposing end of the handle portion 102. The handle portion 102 comprises a reservoir 125 that may be blow molded PVC and is flexible in order to allow for dispensing the cleaning fluid 124 by way of squeezing the side walls thereof.

The handle portion 102 may include a clear silicone top layer 120, as shown in FIG. 2, that allows a user to view the amount of cleaning fluid 124 remaining in the reservoir 125 by way of a longitudinal slot 122 within the reservoir 125.

Referring now to FIG. 4, the tread brush 104 includes a conduit 132 having a first end and a second end. A one way valve 130 has a first end coupled to the reservoir 125 and a second end coupled to the first end of the conduit 132. The second end of the conduit 132 is coupled to the orifice 112 that is at the interface of the bristles 106. The tread bristles 106 are formed into a lower group and an upper group divided by a groove formed therebetween. The orifice is positioned within the groove at the interface of the tread bristles 106.

In operation, a user gently squeezes the reservoir 125 in order to force the cleaning fluid 124 from the reservoir 125 through the one-way valve 130 through the orifice 112 and onto the bristles 105 of the tread brush 104. Using a back and forth motion, the tread brush 104 can be swiped between the treads of a shoe sole in order to dislodge any material caught therebetween. The cleaning solution 124 helps to soften the material and also to disinfect the shoe sole. Once the material has been dislodged from between the treads, the grooming brush 108 can be used to gently wipe the shoe sole. The one-way valve 130 prevents the cleaning solution 124 from running out on its own. Alternatively, or in addition to the one-way valve 130, the orifice 112 may be sized small enough to prevent the cleaning solution 124 from running out on its own.

The cleaning solution 124 may be comprised of any all-purpose cleaner, anti-microbial, antibacterial, sanitizing and de-odorizing agent, leather or vinyl treatment, other cleaning agent, polish or shining agent, dish cleaner, or soap, for example.

In a particular embodiment, the grooming brush 108 can be removed from the handle portion 102 in order to fill the reservoir 125 with cleaning fluid 124. For example, the grooming brush 108 slidingly engages the handle portion 102 using a friction fit and is configured to be removed to fill the reservoir 125 with the cleaning fluid 124. In another particular embodiment, the grooming brush 108 is permanently fixed to the handle 102 so that the device 100 is non-refillable with the cleaning fluid 124 and is disposable.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A device to clean a shoe sole, the device comprising:

a handle portion having a first end and an opposing second end, and configured to store a cleaning fluid therein;

a tread brush coupled to the first end of the handle portion;

a grooming brush coupled to the opposing second end of the handle portion; and the tread brush having bristles on a front side and an orifice in fluid communication with the handle portion, and the first end of the handle portion comprises a tapered end that extends outward in a longitudinal direction from the tread brush;

wherein the tapered end comprises a contiguous flat side aligned with the front side of the tread brush, wherein the flat side is configured to slide along the shoe sole, and an opposing rear sloping side of the tapered end forms a right triangular shape with the flat side, wherein a width and a thickness of the tapered end decreases along its length to a truncated tip that is configured to remove debris within treads of the shoe sole.

2. The device of claim 1, wherein the handle portion comprises a reservoir to store the cleaning fluid.

3. The device of claim 1, wherein the tread brush comprises tread bristles facing outward relative to a first side of the handle portion, and the grooming brush comprises grooming bristles facing outward relative to an opposing second side of the handle portion.

4. The device of claim 1, wherein the orifice comprises a spray nozzle.

5. The device of claim 2, wherein the grooming brush is configured to be removable from the handle portion in order to fill the reservoir with the cleaning fluid.

6. The device of claim 3, wherein the tread bristles are formed into a lower group and an upper group divided by a groove formed therebetween, the orifice being positioned within the groove at the interface of the tread bristles.

7. The device of claim 3, wherein the tread brush comprises a conduit having a first end and a second end.

8. The device of claim 7, wherein the tread brush comprises a one-way valve having a first end coupled to the reservoir and a second end coupled to the first end of the conduit.

9. The device of claim 8, wherein the second end of the conduit is coupled to the orifice that is at an interface of the tread bristles.

10. A device to clean a shoe sole, the device comprising:

a handle portion having a first end and an opposing second end;

a tread brush having tread bristles on a front side and coupled to the first end of the handle portion, the tread bristles formed into a lower group and an upper group divided by a groove formed therebetween, and the first end of the handle portion comprises a tapered end that extends outward in a longitudinal direction from the tread brush;

an orifice positioned within the groove at an interface of the tread bristles; and a grooming brush coupled to the opposing second end of the handle portion;

wherein the tapered end comprises a contiguous flat side aligned with the front side of the tread brush, wherein the flat side is configured to slide along the shoe sole, and an opposing rear sloping side of the tapered end forms a right triangular shape with the flat side, wherein a width and a thickness of the tapered end decreases along its length to a truncated tip that is configured to remove debris within treads of the shoe sole.

11. The device of claim 10, wherein the tread brush comprises tread bristles facing outward relative to a first side of the handle portion, and the grooming brush comprises grooming bristles facing outward relative to an opposing second side of the handle portion.

12. The device of claim 10, wherein the handle portion comprises a reservoir to store cleaning fluid therein.

13. The device of claim 12, wherein the tread brush comprises a conduit having a first end and a second end.

14. The device of claim 13, wherein the tread brush comprises a one-way valve having a first end coupled to the reservoir and a second end coupled to the first end of the conduit.

15. The device of claim 14, wherein the second end of the conduit is coupled to the orifice that is at the interface of the tread bristles.

16. The device of claim 12, wherein the grooming brush slidingly engages the handle portion and is configured to be removed to fill the reservoir with the cleaning fluid.

17. The device of claim 10, wherein the orifice comprises a spray nozzle.

18. A device to clean a shoe sole, the device comprising:

a handle portion having a first end and an opposing second end, and a reservoir configured to contain a cleaning fluid;

a tread brush having tread bristles on a front side and coupled to the first end of the handle portion, the tread bristles formed into a lower group and an upper group divided by a groove formed therebetween, and the first end of the handle portion comprises a tapered end that extends outward in a longitudinal direction from the tread brush;

an orifice positioned within the groove at an interface of the tread bristles;

a grooming brush coupled to the opposing second end of the handle portion;

the tread brush comprises a one-way valve having a first end coupled to the reservoir and a second end coupled to the orifice;

wherein the grooming brush slidingly engages the handle portion and is configured to be removed to fill the reservoir with the cleaning fluid;

wherein the tapered end comprises a contiguous flat side aligned with the front side of the tread brush, wherein the flat side is configured to slide along the shoe sole, and an opposing rear sloping side of the tapered end forms a right triangular shape with the flat side, wherein a width and a thickness of the tapered end decreases along its length to a truncated tip that is configured to remove debris within treads of the shoe sole.

* * * * *